US005918669A

United States Patent [19]

Morris et al.

[11] Patent Number: 5,918,669

[45] Date of Patent: Jul. 6, 1999

[54] METHOD AND APPARATUS FOR REMOTE CONTROL OF MULTILATERAL WELLS

[75] Inventors: Arthur J. Morris, Magnolia; Ronald E. Pringle, Houston, both of Tex.

[73] Assignee: Camco International, Inc., Houston, Tex.

[21] Appl. No.: 08/638,027

[22] Filed: Apr. 26, 1996

[51] Int. Cl.[6] ..... E21B 23/03; E21B 34/14; E21B 43/12

[52] U.S. Cl. ..... 166/50; 166/66.4; 166/66.6; 166/117.6; 166/313; 166/332.2; 166/332.4

[58] Field of Search ..... 166/50, 66.4, 66.6, 166/117.6, 191, 313, 332.2, 332.4, 330

[56] References Cited

U.S. PATENT DOCUMENTS

| | | | |
|---|---|---|---|
| 2,304,303 | 12/1942 | Ferguson . | |
| 2,710,655 | 6/1955 | Collett . | |
| 2,803,197 | 8/1957 | Wiley et al. . | |
| 3,073,392 | 1/1963 | Dinning et al. . | |
| 3,581,820 | 6/1971 | Burns . | |
| 3,665,955 | 5/1972 | Conner . | |
| 4,094,359 | 6/1978 | King . | |
| 4,124,070 | 11/1978 | King et al. . | |
| 4,402,551 | 9/1983 | Wood et al. . | |
| 4,700,782 | 10/1987 | Read | 166/330 |
| 5,253,712 | 10/1993 | Swor | 166/330 |
| 5,337,808 | 8/1994 | Graham . | |
| 5,388,648 | 2/1995 | Jordan . | |
| 5,411,085 | 5/1995 | Moore et al. . | |
| 5,439,051 | 8/1995 | Kennedy et al. | 166/50 |
| 5,447,201 | 9/1995 | Mohn . | |
| 5,474,131 | 12/1995 | Jordan et al. . | |
| 5,564,503 | 10/1996 | Longbottom et al. | 116/117.6 |

*Primary Examiner*—George A. Suchfield

[57] ABSTRACT

A method and apparatus for selectively producing fluids from multiple lateral wellbores that extend from a central wellbore. The apparatus comprises a fluid flow assembly with a selectively openable and adjustable flow control valve in communication with a production tubing, located in the central wellbore between packers, and a lateral wellbore, and a selectively openable access door located adjacent the lateral wellbore allowing and preventing service tool entry into the lateral wellbore. The valve and door are individually controlled from the earth's surface.

17 Claims, 19 Drawing Sheets

METHOD AND APPARATUS FOR REMOTE CONTROL OF MULTILATERAL WELLS

BACKGROUND OF THE INVENTION

1. Field of the Invention.

The present invention relates to subsurface well completion equipment and, more particularly, to methods and related apparatus for remotely controlling fluid recovery from multiple laterally drilled wellbores.

2. Description of Related Art.

Hydrocarbon recovery volume from a vertically drilled well can be increased by drilling additional wellbores from that same well. For example, the fluid recovery rate and the well's economic life can be increased by drilling a horizontal or highly deviated interval from a main wellbore radially outward into one or more formations. Still further increases in recovery and well life can be attained by drilling multiple deviated intervals into multiple formations. Once the multilateral wellbores have been drilled and completed there is a need for the recovery of fluids from each wellbore to be individually controlled. Currently, the control of the fluid recovery from these multilateral wellbores has been limited in that once a lateral wellbore has been opened it is not possible to selectively close off and/or reopen the lateral wellbores without the need for the use of additional equipment, such as wireline units, coiled tubing units and workover rigs.

The need for selective fluid recovery is important in that individual producing intervals usually contain hydrocarbons that have different physical and chemical properties and as such may have different unit values. Co-mingling a valuable and desirable crude with one that has, for instance, a high sulfur content would not be commercially expedient, and in some cases is prohibited by governmental regulatory authorities. Also, because different intervals inherently contain differing volumes of hydrocarbons, it is highly probable that one interval will deplete before the others, and will need to be easily and inexpensively closed off from the vertical wellbore before the other intervals.

The use of workover rigs, coiled tubing units and wireline units are relatively inexpensive if used onshore and in typical oilfield locations; however, mobilizing these resources for a remote offshore well can be very expensive in terms of actual dollars spent, and in terms of lost production while the resources are being moved on site. In the case of subsea wells (where no surface platform is present), a drill ship or workover vessel mobilization would be required to merely open/close a downhole wellbore valve.

The following patents disclose the current multilateral drilling and completion techniques. U.S. Pat. No. 4,402,551 details a simple completion method when a lateral wellbore is drilled and completed through a bottom of an existing traditional, vertical wellbore. Control of production fluids from a well completed in this manner is by traditional surface wellhead valving methods, since improved methods of recovery from only one lateral and one interval is disclosed. The importance of this patent is the recognition of the role of orienting and casing the lateral wellbore, and the care taken in sealing the juncture where the vertical borehole interfaces with the lateral wellbore.

U.S. Pat. No. 5,388,648 discloses a method and apparatus for sealing the juncture between one or more horizontal wells using deformable sealing means. This completion method deals primarily with completion techniques prior to insertion of production tubing in the well. While it does address the penetration of multiple intervals at different depths in the well, it does not offer solutions as to how these different intervals may be selectively produced.

U.S. Pat. No. 5,337,808 discloses a technique and apparatus for selective multi-zone vertical and/or horizontal completions. This patent illustrates the need to selectively open and close individual intervals in wells where multiple intervals exist, and discloses devices that isolate these individual zones through the use of workover rigs.

U.S. Pat. No. 5,447,201 discloses a well completion system with selective remote surface control of individual producing zones to solve some of the above described problems. Similarly, U.S. Pat. No. 5,411,085, commonly assigned hereto, discloses a production completion system which can be remotely manipulated by a controlling means extending between downhole components and a panel located at the surface. Each of these patents, while able to solve recovery problems without a workover rig, fails to address the unique problems associated with multilateral wells, and teaches only recovery methods from multiple interval wells. A multilateral well that requires reentry remediation which was completed with either of these techniques has the same problems as before: the production tubing would have to be removed, at great expense, to re-enter the lateral for remediation, and reinserted in the well to resume production.

U.S. Pat. No. 5,474,131 discloses a method for completing multi-lateral wells and maintaining selective re-entry into the lateral wellbores. This method allows for re-entry remediation into deviated laterals, but does not address the need to remotely manipulate downhole completion accessories from the surface without some intervention technique. In this patent, a special shifting tool is required to be inserted in the well on coiled tubing to engage a set of ears to shift a flapper valve to enable selective entry to either a main wellbore or a lateral. To accomplish this, the well production must be halted, a coiled tubing company called to the job site, a surface valving system attached to the wellhead must be removed, a blow out preventer must be attached to the wellhead, a coiled tubing injector head must be attached to the blow out preventer, and the special shifting tool must be attached to the coiled tubing; all before the coiled tubing can be inserted in the well.

There is a need for a system to allow an operator standing at a remote control panel to selectively permit and prohibit flow from multiple lateral well branches drilled from a common central wellbore without having to resort to common intervention techniques. Alternately, there is a need for an operator to selectively open and close a valve to implement re-entry into a lateral branch drilled from the common wellbore. There is a need for redundant power sources to assure operation of these automated downhole devices, should one or more power sources fail. Finally, there is a need for fail safe mechanical recovery tools, should these automated systems become inoperative.

SUMMARY OF THE INVENTION

The present invention has been contemplated to overcome the foregoing deficiencies and meet the above described needs. Specifically, the present invention is a system to recover fluids from a well that has either multiple producing zones adjacent to a central wellbore or has multiple lateral wellbores which have been drilled from a central wellbore into a plurality of intervals in proximity to the central wellbore. In accordance with the present invention an improved method is disclosed to allow selective recovery from any of a well's intervals by remote control from a panel located at the earth's surface. This selective recovery is enabled by any number of well known controlling means, i.e. by electrical signal, by hydraulic signal, by fiber optic signal, or any combination thereof, such combination comprising a piloted signal of one of these controlling means to operate another. Selective control of producing formations would preclude the necessity of expensive, but commonly practiced workover techniques to change producing zones, such as: (1) standard tubing conveyed intervention, should a production tubing string need to be removed or deployed in the well, or (2) should a work string need to be utilized for remediation, and would also reduce the need and frequency of either (3) coiled tubing remediation or (4) wireline procedures to enact a workover, as well.

Preferably, these controlling means may be independent and redundant, to assure operation of the production system in the event of primary control failure; and may be operated mechanically by the aforementioned commonly practiced workover techniques to change producing zones, should the need arise.

In a preferred embodiment, a well comprising a central casing adjacent at least two hydrocarbon producing formations is cemented in the earth. A production tubing string located inside the casing is fixed by any of several well known completion accessories. Packers, which are well known to those skilled in the art, straddle each of the producing formations and seal an annulus, thereby preventing the produced wellbore fluids from flowing to the surface in the annulus. A surface activated flow control valve with an annularly openable orifice, located between the packers, may be opened or closed upon receipt of a signal transmitted from the control panel, with each producing formation between a wellhead at the surface, and the lowermost producing formation having a corresponding flow control valve. With such an arrangement, any formation can be produced by opening its corresponding flow control valve and closing all other flow control valves in the wellbore. Thereafter, co-mingled flow from individual formations is prevented, or allowed, as is desired by the operations personnel at the surface control panel. Further, the size of the annularly openable orifice can be adjusted from the surface control panel such that the rate of flow of hydrocarbons therefrom can be adjusted as operating conditions warrant.

Should conditions in one or more of the laterals warrant re-entry by either coiled tubing or other well known methods, a rotating lateral access door directly adjacent to and oriented toward each lateral in the well can be selectively opened, upon receipt of a signal from the control panel above. The access door, in the open position, directs service tools inserted into the central wellbore into the selected lateral. Closure of the access door, prevents entry of service tools running in the central wellbore from entering laterals that were not selected for remediation.

In accordance with this preferred embodiment, should either the flow control valve or the rotating lateral access door lose communication with the surface control panel, or should either device become otherwise inoperable by remote control, mechanical manipulation devices that may be deployed by coiled tubing are within the scope of this invention and are disclosed herein.

The features and advantages of the present invention will be appreciated and understood by those skilled in the art from the following detailed description and drawings.

BRIEF DESCRIPTION OF THE DRAWINGS

FIG. 4-A depicts the cross section with a rotating lateral access door shown in the open position, while FIG. 4-B depicts the cross section with the rotating lateral access door shown in the closed position.

DETAILED DESCRIPTION OF THE PREFERRED EMBODIMENTS

The present invention is a system for remotely controlling multilateral wells, and will be described in conjunction with its use in a well with three producing formations for purposes of illustration only. One skilled in the art will appreciate many differing applications of the described apparatus. It should be understood that the described invention may be used in multiples for any well with a plurality of producing formations where either multiple lateral branches of a well are present, or multiple producing formations that are conventionally completed, such as by well perforations or uncased open hole, or by any combination of these methods. Specifically, the apparatus of the present invention includes enabling devices for automated remote control and access of multiple formations in a central wellbore during production, and allow work and time saving intervention techniques when remediation becomes necessary.

For the purposes of this discussion, the terms "upper" and "lower", "up hole" and "downhole", and "upwardly" and downwardly" are relative terms to indicate position and direction of movement in easily recognized terms. Usually, these terms are relative to a line drawn from an upmost position at the surface to a point at the center of the earth, and would be appropriate for use in relatively straight, vertical wellbores. However, when the wellbore is highly deviated, such as from about 60 degrees from vertical, or horizontal these terms do not make sense and therefore should not be taken as limitations. These terms are only used for ease of understanding as an indication of what the position or movement would be if taken within a vertical wellbore.

Figure 1:
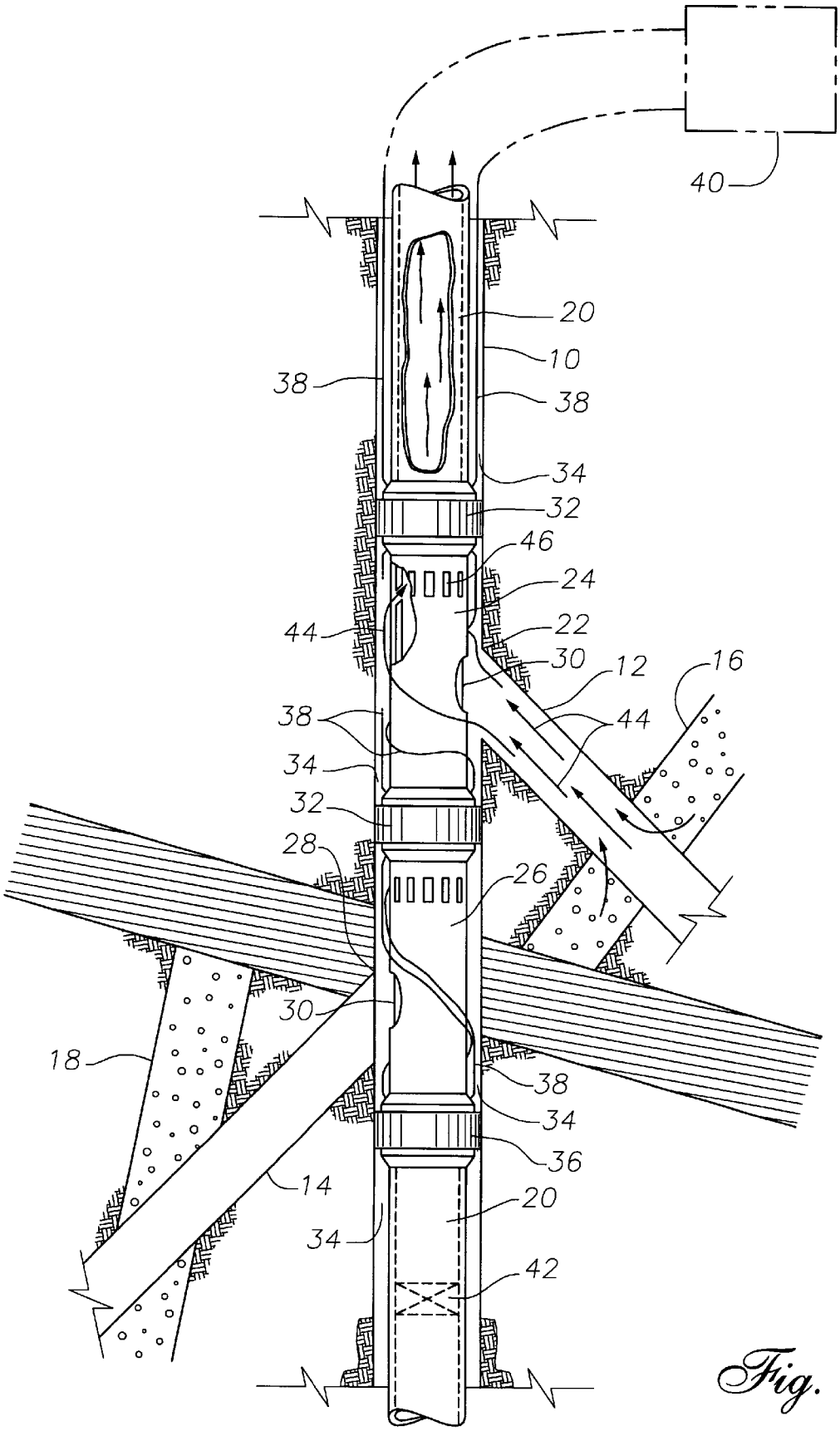
FIG. 1 is a schematic representation of a wellbore completed using one preferred embodiment of the present invention.
Figure 2A:
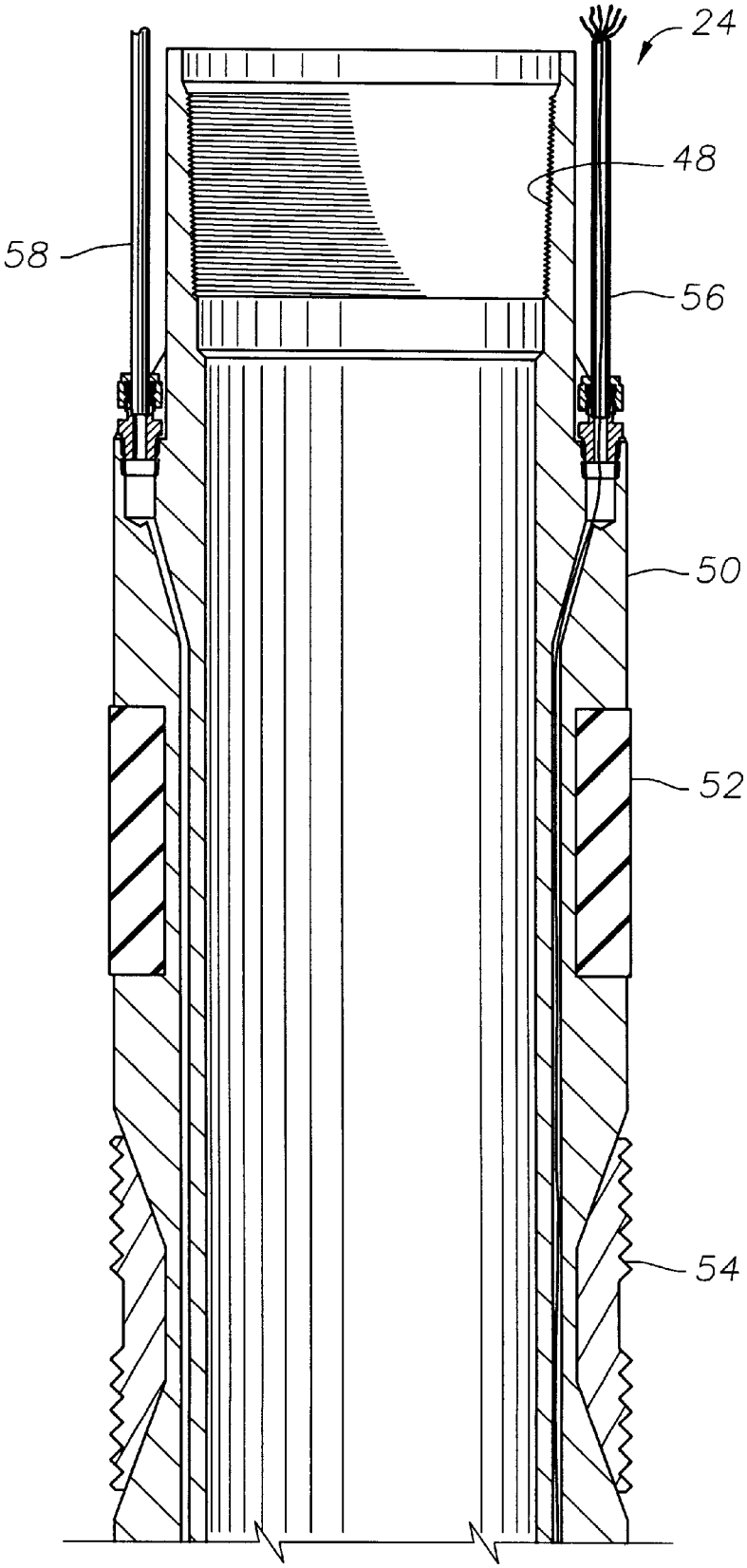
FIGS. 2 A–G taken together form a longitudinal section of one preferred embodiment of an apparatus of the present invention with a lateral access door in the open position.
Figure 2B:
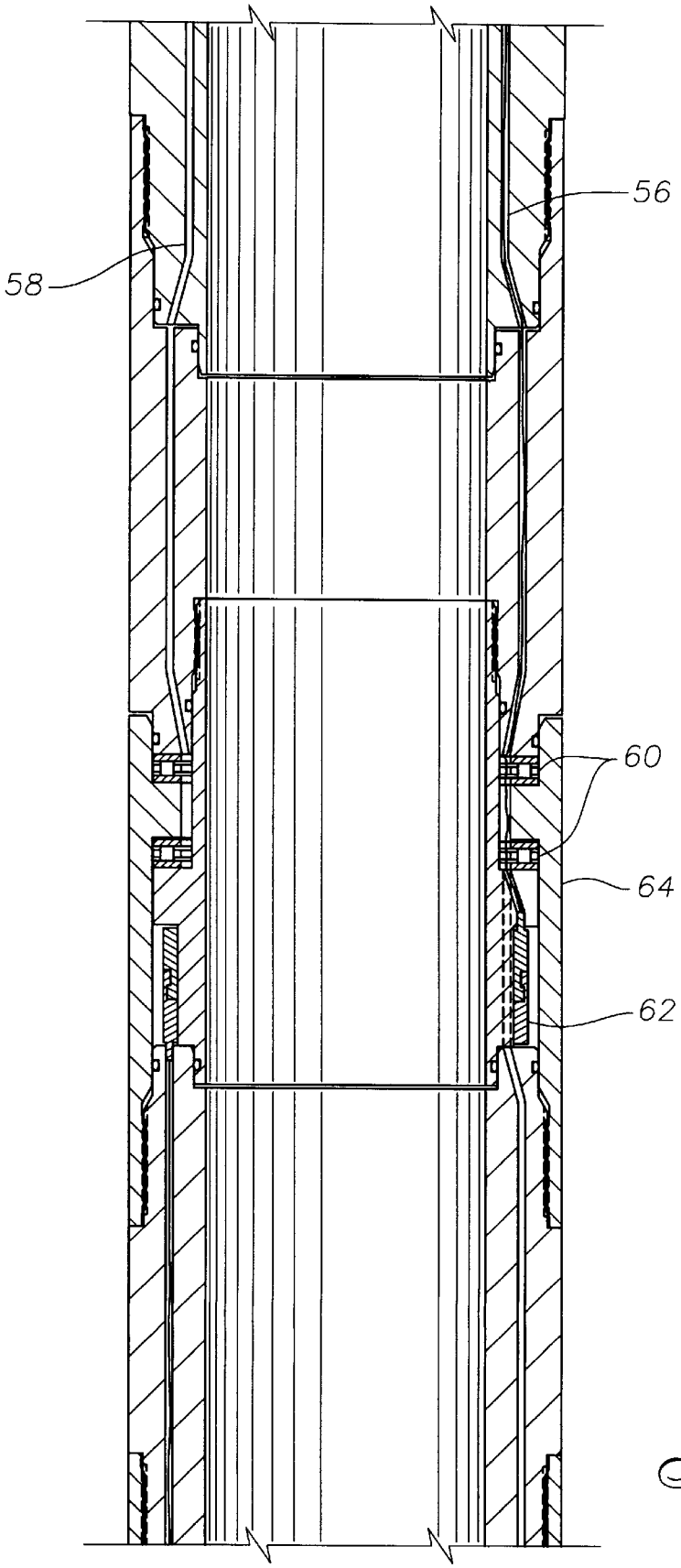
Figure 2C:
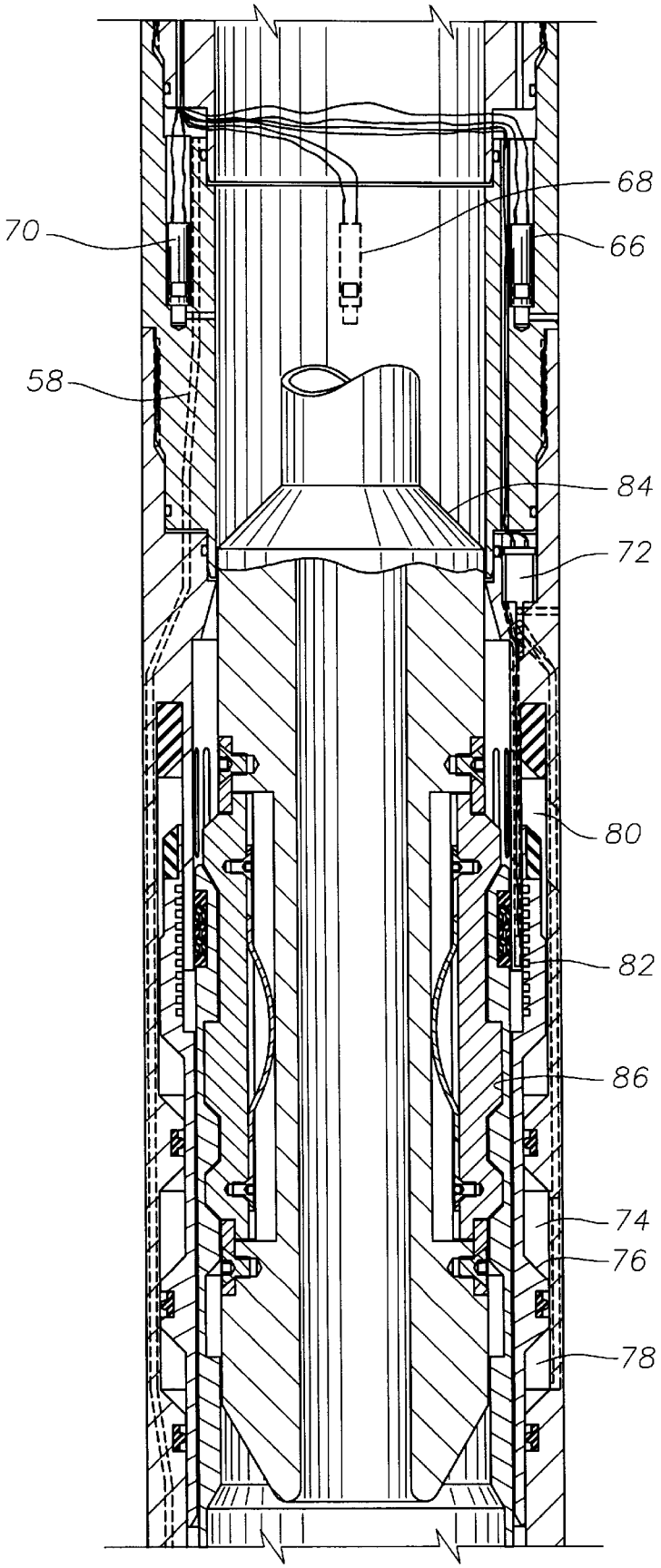
Figure 2D:
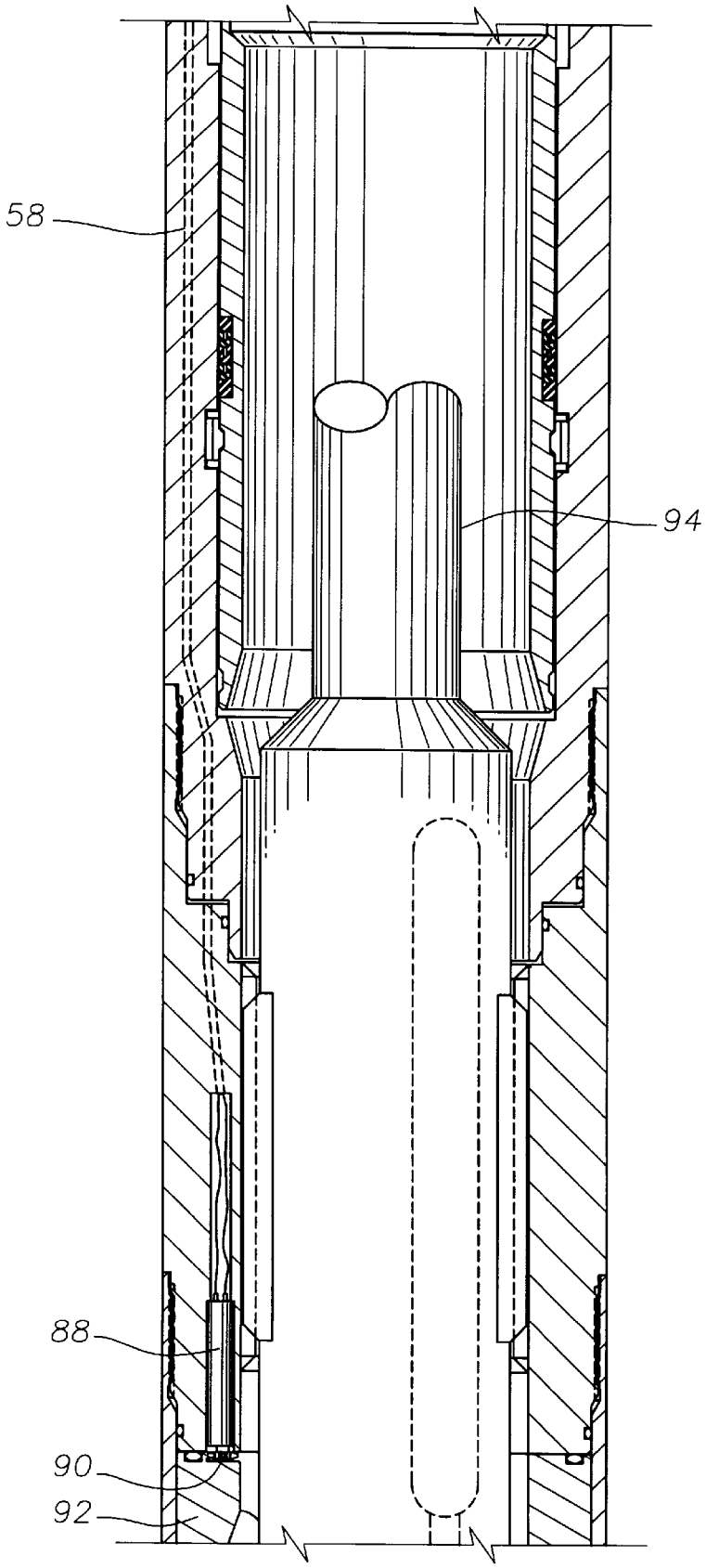
Figure 2E:
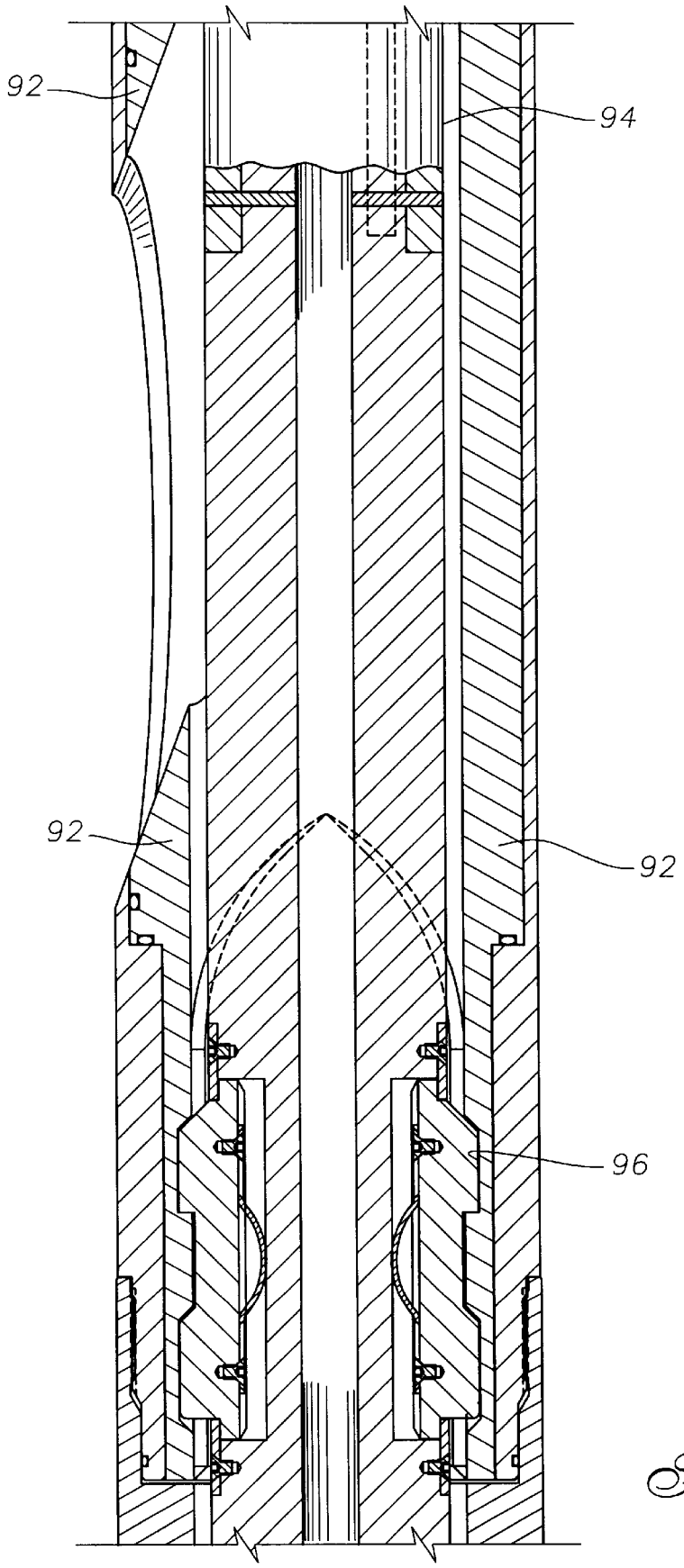
Figure 2F:
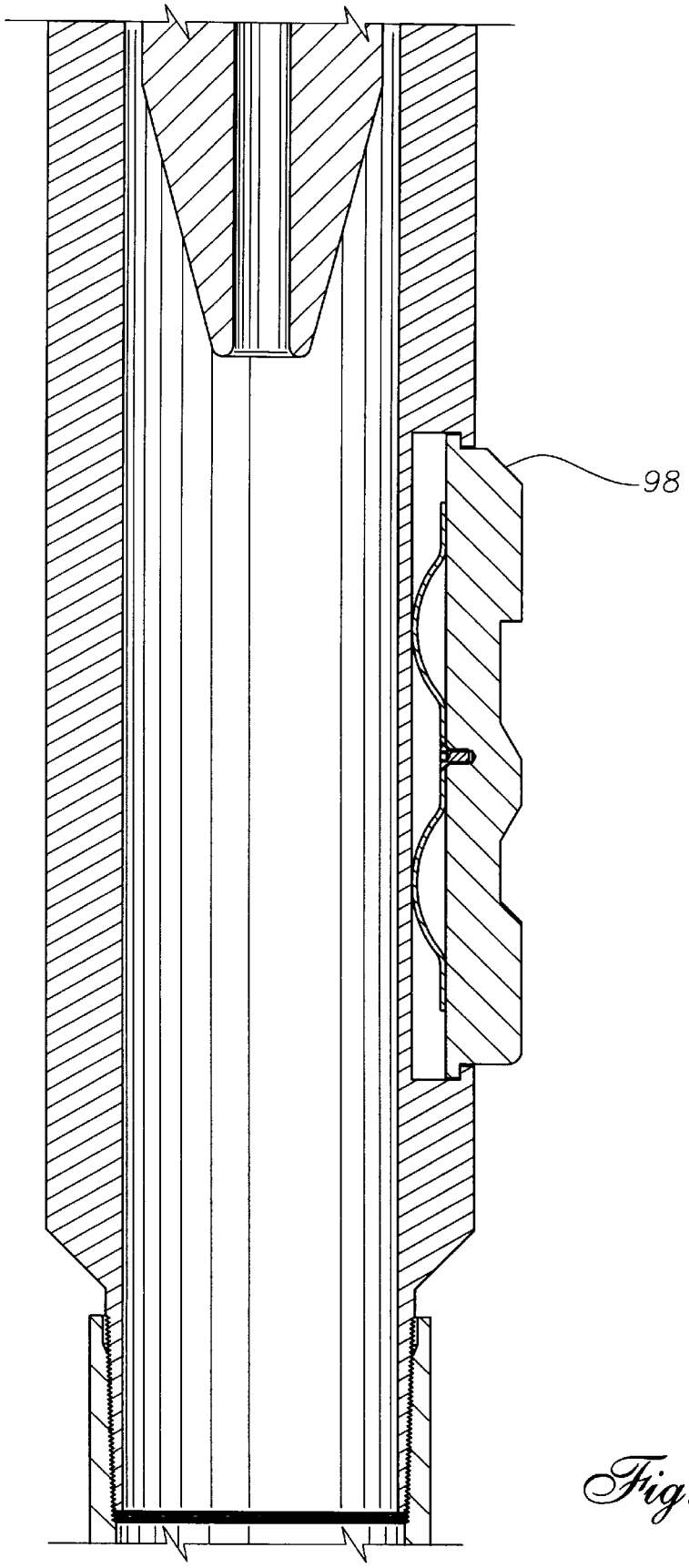
Figure 2G:
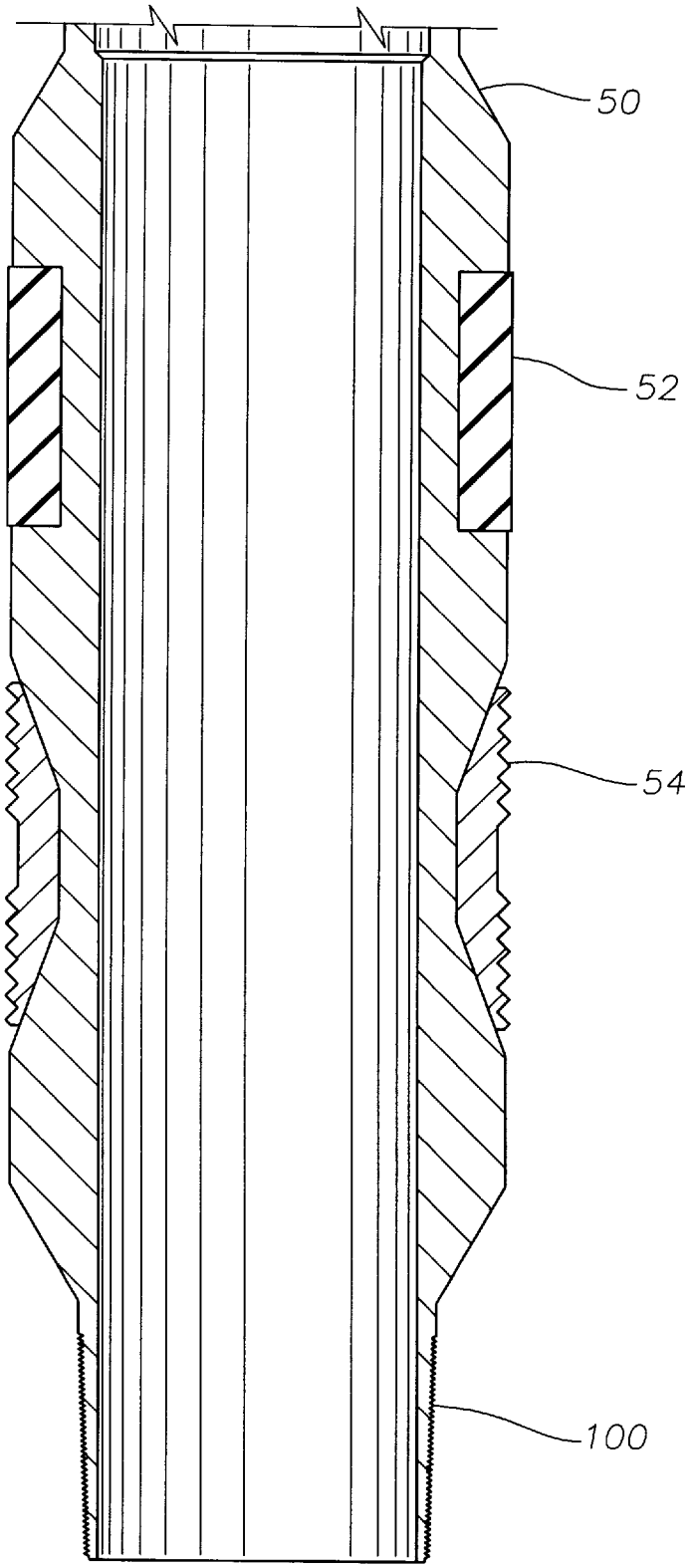
Figure 3A:
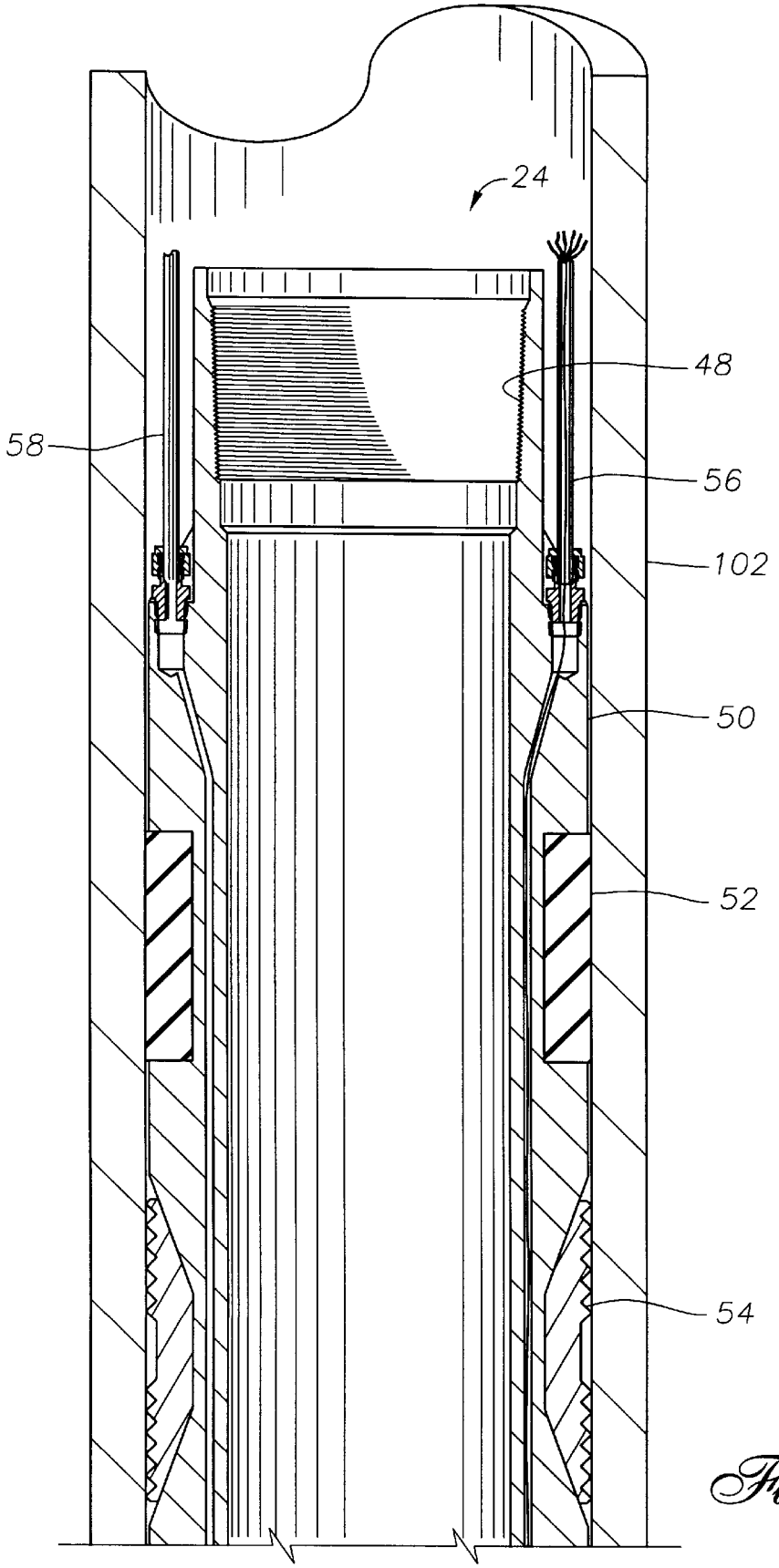
FIGS. 3 A–H taken together form a longitudinal section of the apparatus of FIG. 2 with a work string shown entering a lateral, and a longitudinal section of a selective orienting deflector tool located in position.
Figure 3B:
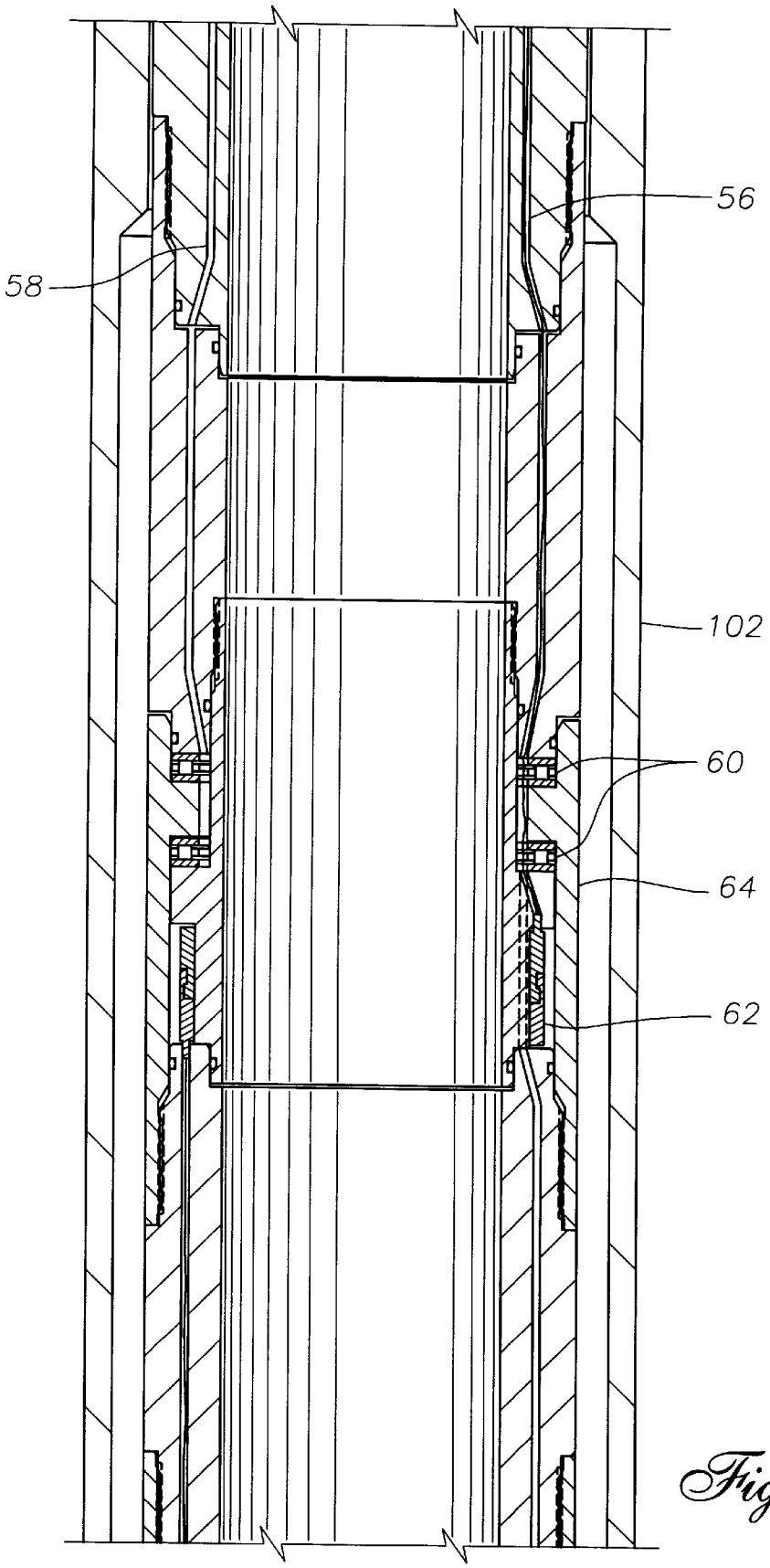
Figure 3C:
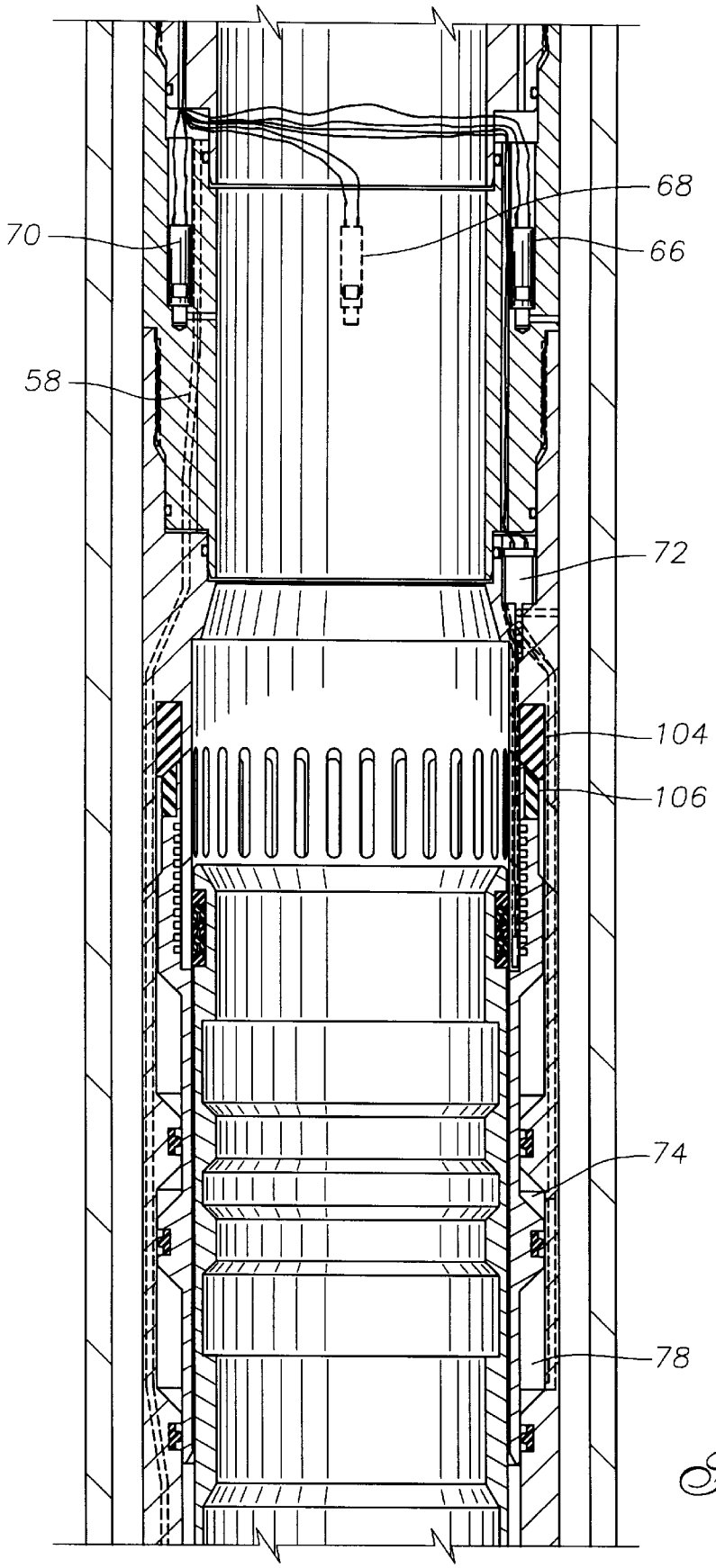
Figure 3D:
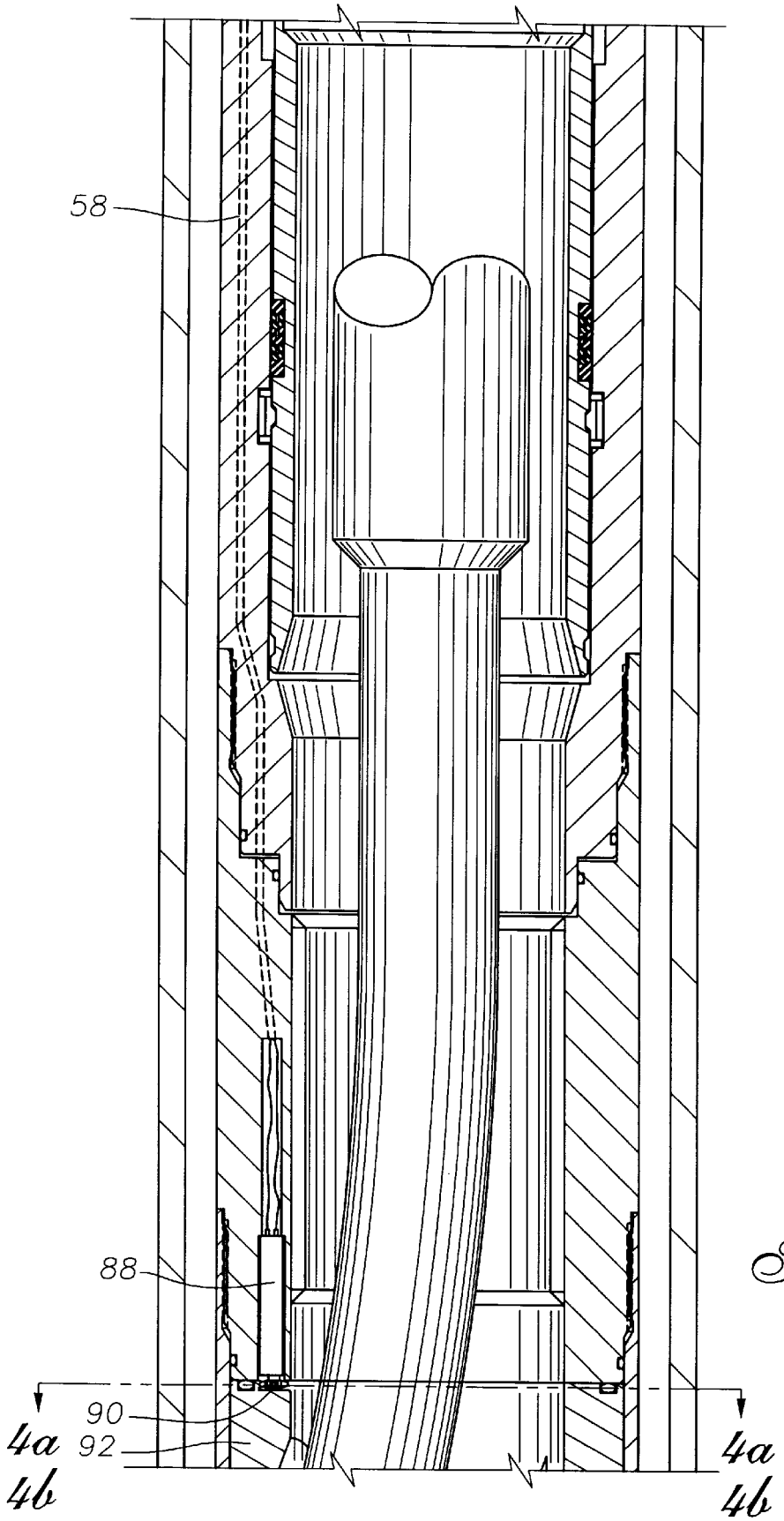
Figure 3E:
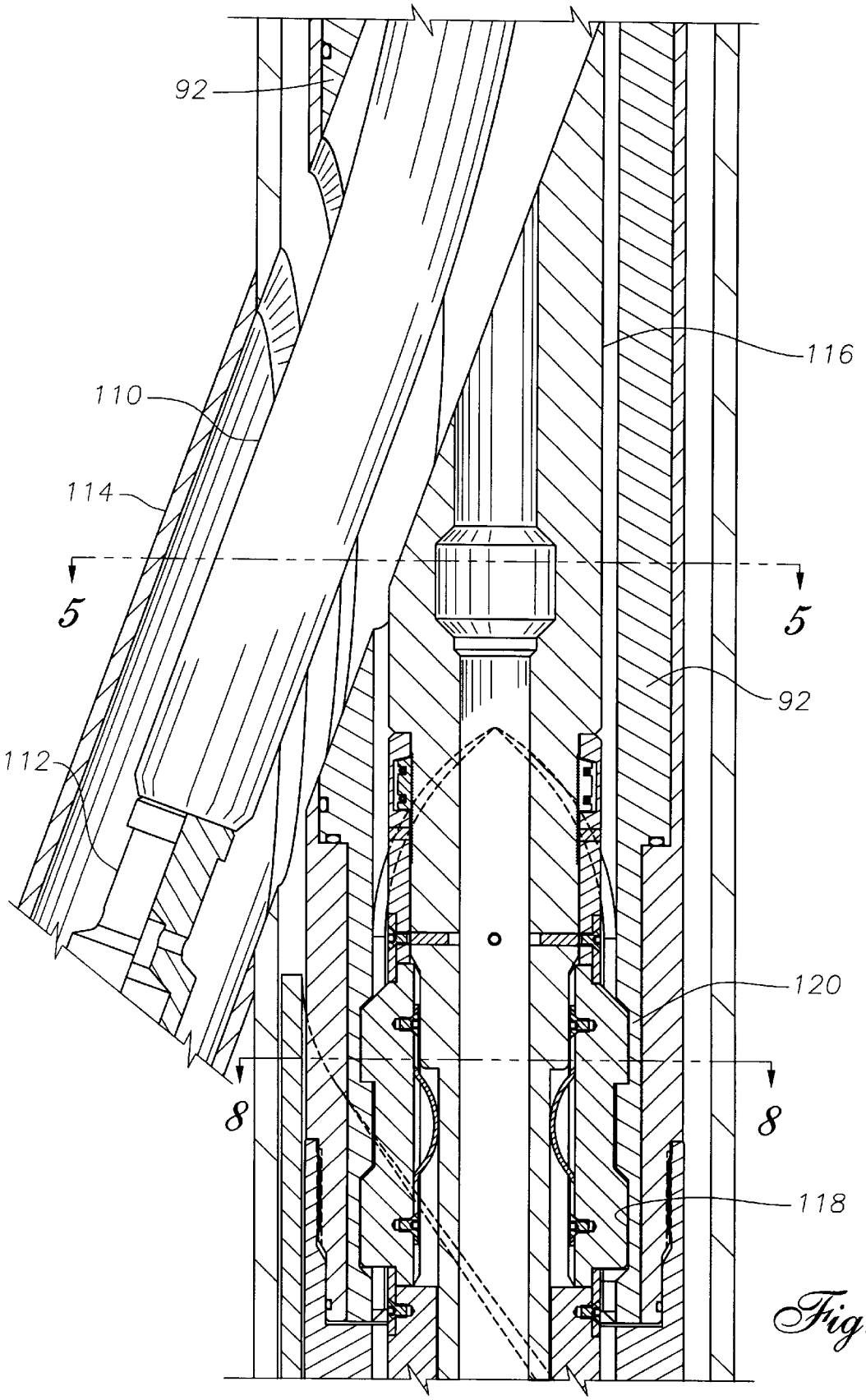
Figure 3F:
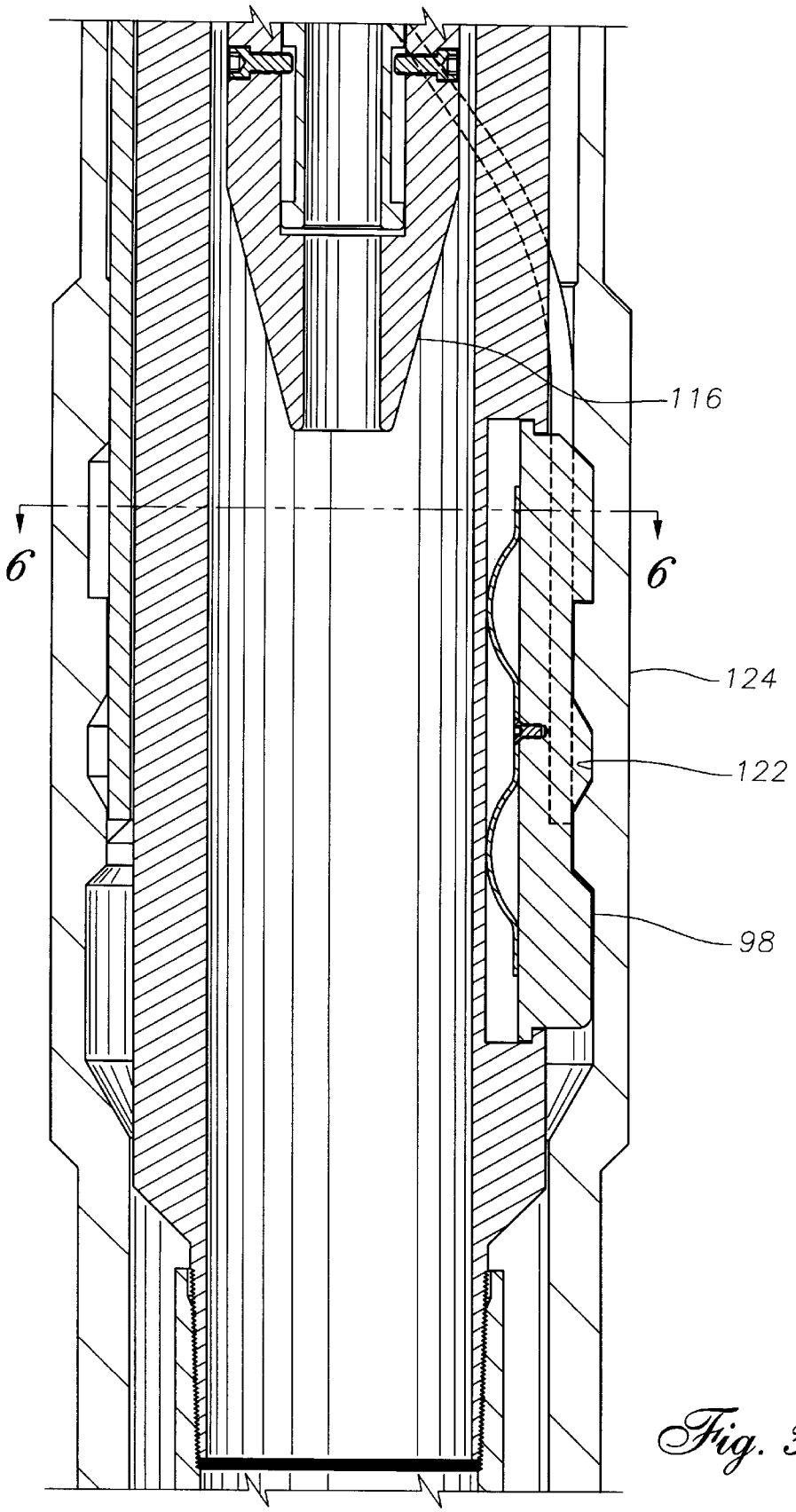
Figure 3G:
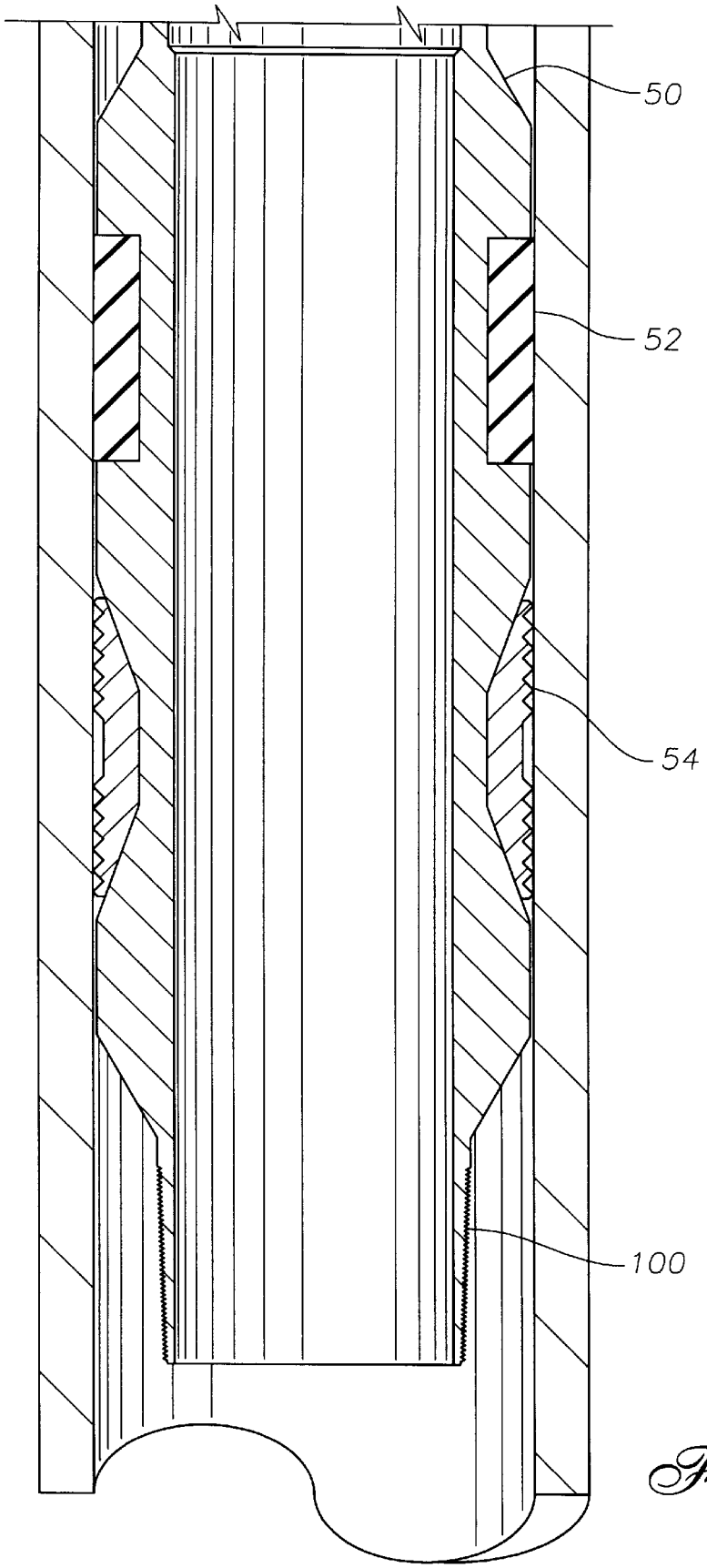
Figure 3H:
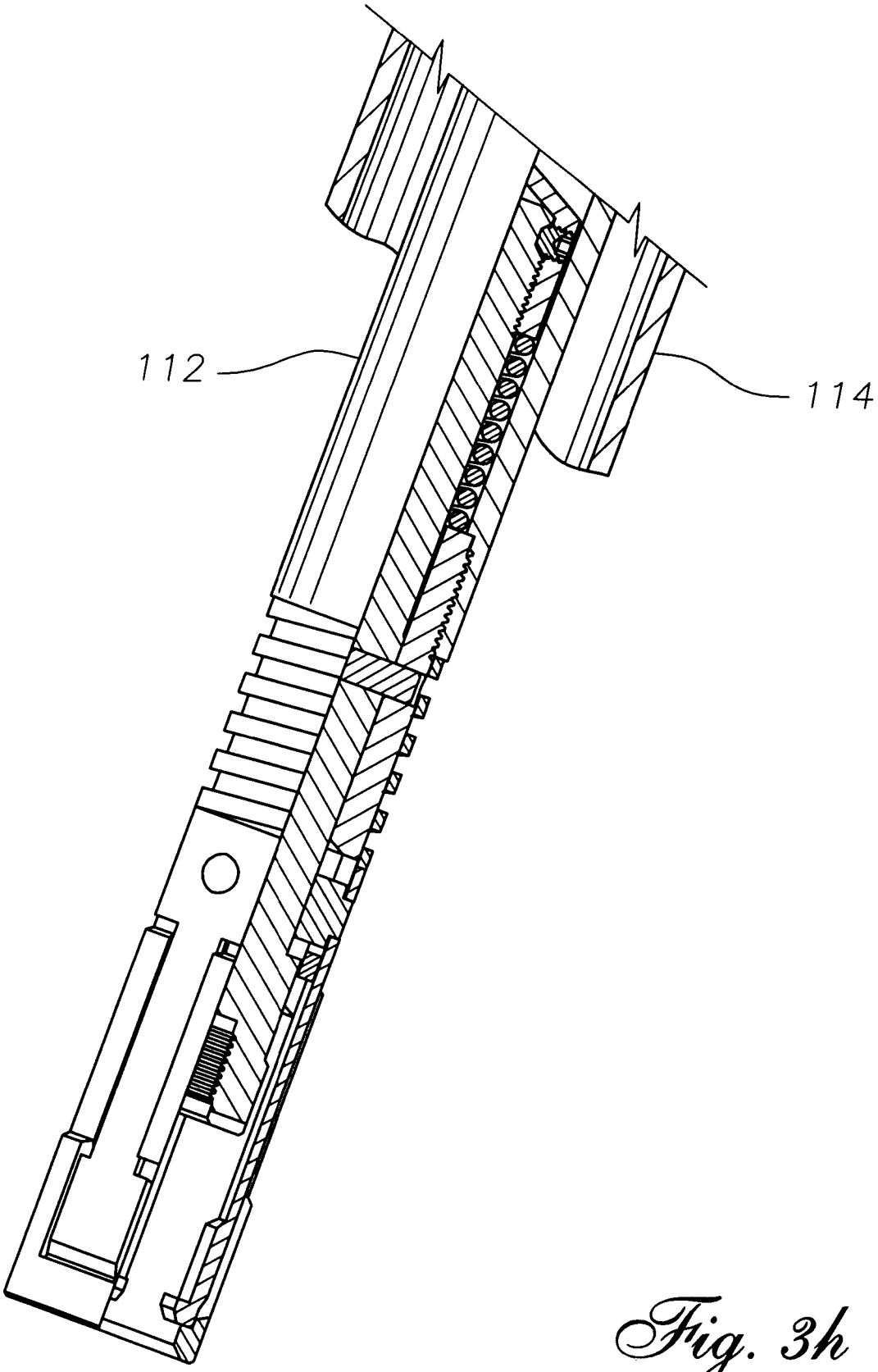

Referring not to FIG. 1, a substantially vertical wellbore 10 is shown with an upper lateral wellbore 12 and a lower lateral wellbore 14 drilled to intersect an upper producing zone 16 and an intermediate producing zone 18, as is well known to those skilled in the art of multilateral drilling. A production tubing 20 is suspended inside the vertical wellbore 10 for recovery of fluids to the earth's surface. Adjacent to an upper lateral well junction 22 is an upper fluid flow control apparatus 24 of the present invention while a lower fluid flow control apparatus 26 of the present invention is located adjacent to a lower lateral well junction 28. Each fluid flow control apparatus 24 and 26 are the same as or similar in configuration. In one preferred embodiment, the fluid flow control apparatus 24 and 26 generally comprises a generally cylindrical mandrel body having a central longitudinal bore extending therethrough, with threads or other connection devices on one end thereof for interconnection to the production tubing 20. A selectively operable lateral access door is provided in the mandrel body for alternately permitting and preventing a service tool from laterally exiting the body therethrough and into a lateral wellbore. In addition, in one preferred embodiment, a selectively operable flow control valve is provided in the body for regulating fluid flow between the outside of the body and the central bore.

In the fluid flow control apparatus 24 a lateral access door 30 comprises an opening in the body and a door or plug member. The door may be moved longitudinally or radially, and may be moved by one or more means, as will be described in more detail below. In FIG. 1 the door 30 is shown oriented toward its respective adjacent lateral wellbore. A pair of permanent or retrievable elastomeric packers 32 are provided on separate bodies that are connected by threads to the mandrel body or, preferably, are connected as part of the mandrel body. The packers 32 are used to isolate fluid flow between producing zones 16 and 18 and provide a fluidic seal thereby preventing co-mingling flow of produced fluids through a wellbore annulus 34. A lowermost packer 36 is provided to anchor the production tubing 20, and to isolate a lower most producing zone (not shown) from the producing zones 16 and 18 above. A communication conduit or cable or conduit 38 is shown extending from the fluid flow control apparatus 26, passing through the isolation packers 32, up to a surface control panel 40. A tubing plug 42, which is well known, may be used to block flow from the lower most producing zone (not shown) into the tubing 20.

A well with any multiple of producing zones can be completed in this fashion, and a large number of flow configurations can be attained with the apparatus of the present invention. For the purposes of discussion, all these possibilities will not be discussed, but remain within the spirit and scope of the present invention. In the configuration shown in FIG. 1, the production tubing 20 is plugged at the lower end by the tubing plug 42, the lower fluid flow control apparatus 26 has a flow control valve that is shown closed, and the upper fluid flow control apparatus 24 is shown with its flow control valve in the open position. This production configuration is managed by an operator standing on the surface at the control panel 40, and can be changed therewith by manipulation of the controls on that panel. In this production configuration, flow from all producing formations is blocked, except from the upper producing zone 16. Hydrocarbons 44 present therein will flow from the formation 16, through the upper lateral 12, into the annulus 34 of the vertical wellbore 10, into a set of ports 46 in the mandrel body and into the interior of the production tubing 20. From there, the produced hydrocarbons move to the surface.

Turning now to FIGS. 2 A–G, which, when taken together illustrate the fluid flow control apparatus 24. An upper connector 48 is provided on a generally cylindrical mandrel body 50 for sealable engagement with the production tubing 20. An elastomeric packing element 52 and a gripping device 54 are connected to the mandrel body 50. A first communication conduit 56, preferably, but not limited to electrical communication, and a second communication conduit 58, preferably, but not limited to hydraulic control communication, extend from the earth's surface into the mandrel 50. The first 56 and second 58 communication conduits communicate their respective signals to/from the earth's surface and into the mandrel 50 around a set of bearings 60 to a slip joint 62. The electrical communication conduit or cable 56 connects at this location, while the hydraulic communication conduit 58 extends therepast. The bearings 60 reside in a rotating swivel joint 64, which allows the mandrel body 50 and its lateral access door 30 to be rotated relative to tubing 20, to ensure that the lateral access door 30 is properly aligned with the lateral wellbore. Further, the electrical communication conduit or cable 56 communicates with a first pressure transducer 66 to monitor annulus pressure, a temperature and pressure sensor 68 to monitor temperature and hydraulic pressure, and/or a second pressure transducer 70 to monitor tubing pressure. Signals from these transducers are communicated to the control panel 40 on the surface so operations personnel can make informed decisions about downhole conditions.

In this preferred embodiment, the electrical communication conduit or cable also communicates with a solenoid valve 72, which selectively controls the flow of hydraulic fluid from the hydraulic communication conduit 58 to an upper hydraulic chamber 74, across a movable piston 76, to a lower hydraulic chamber 78. The differential pressures in these two chambers 74 and 78 move the operating piston 76 and a sleeve extending therefrom in relation to an annularly openable port or orifice 80 in the mandrel body 50 to allow hydrocarbons to flow from the annulus 34 to the tubing 20. Further, the rate of fluid flow can be controlled by adjusting the relative position of the piston 76 through the use of a flow control position indicator 82, which provides the operator constant and instantaneous feedback as to the size of the opening selected.

In some instances, however, normal operation of the flow control valve may not be possible for any number of reasons. An alternate and redundant method of opening or closing the flow control valve and the annularly operable orifice 80 uses a coiled tubing deployed shifting tool 84 landed in a profile in the internal surface of the mandrel body 50. Pressure applied to this shifting tool 84 is sufficient to move the flow control valve to either the open or closed positions as dictated by operational necessity, as can be understood by those skilled in the art.

The electrical communication conduit or cable 58 further communicates electrical power to a high torque rotary motor 88 which rotates a pinion gear 90 to rotate a lateral access plug member or door 92. This rotational force opens and closes the rotating lateral access door 92 should entry into the lateral wellbore be required. In some instances, however, normal operation rotating lateral access door 92 may not be possible for any number of reasons. An alternate, and redundant method of opening the rotating lateral access door 92 is also provided wherein a coiled tubing deployed rotary tool 94 is shown located in a lower profile 96 in the interior of the mandrel body 50. Pressure applied to this rotary tool 94 is sufficient to rotate the rotating lateral access door 92 to either the open or closed positions as dictated by operational necessity, as would be well known to those skilled in the art.

When the fluid flow apparatus 24 and 26 are set within the wellbore the depth and azimuthal orientation is controlled by a spring loaded, selective orienting key 98 on the mandrel body 50 which interacts with an orienting sleeve within a casing nipple, which is well known to those skilled in the art.

Isolation of the producing zone is assured by the second packing element 52, and the gripping device 54, both mounted on the mandrel body 50, where an integrally formed lower connector 100 for sealable engagement with the production tubing 20 resides.

Referring now to FIGS. 3 A–H which, when taken together illustrate the upper fluid flow control apparatus 24, set and operating in a well casing 102. In this embodiment, an upper valve seat 104 on the mandrel 50 and a lower 106 valve seat on the piston 76 are shown sealably engaged, thereby blocking fluid flow. The lateral access door 92 is in the form of a plug member that is formed at an angle to facilitate movement of service tools into and out of the lateral. Once so opened, a coiled tubing 108, or other well known remediation tool, can be easily inserted in the lateral wellbore. For purposes of illustration, a flexible tubing member 110 is shown attached to the coiled tubing 108, which is in turn, attached to a pulling tool 112, that is being inserted in a cased lateral 114.

A selective orienting deflector tool 116 is shown set in a profile 118 formed in the interior surface of the upper fluid flow control apparatus 24. The deflector tool 116 is located, oriented, and held in position by a set of locking keys 120, which serves to direct any particular service tool inserted in the vertical wellbore 10, into the proper cased lateral 114.

The depth and azimuthal orientation of the assembly as hereinabove discussed is controlled by a spring loaded, selective orienting key 98, which sets in a casing profile 122 of a casing nipple 124. Isolation of the producing zone is assured by the second packing element 52, and the gripping device 54, both mounted on the central mandrel 50.

Figure 4A:
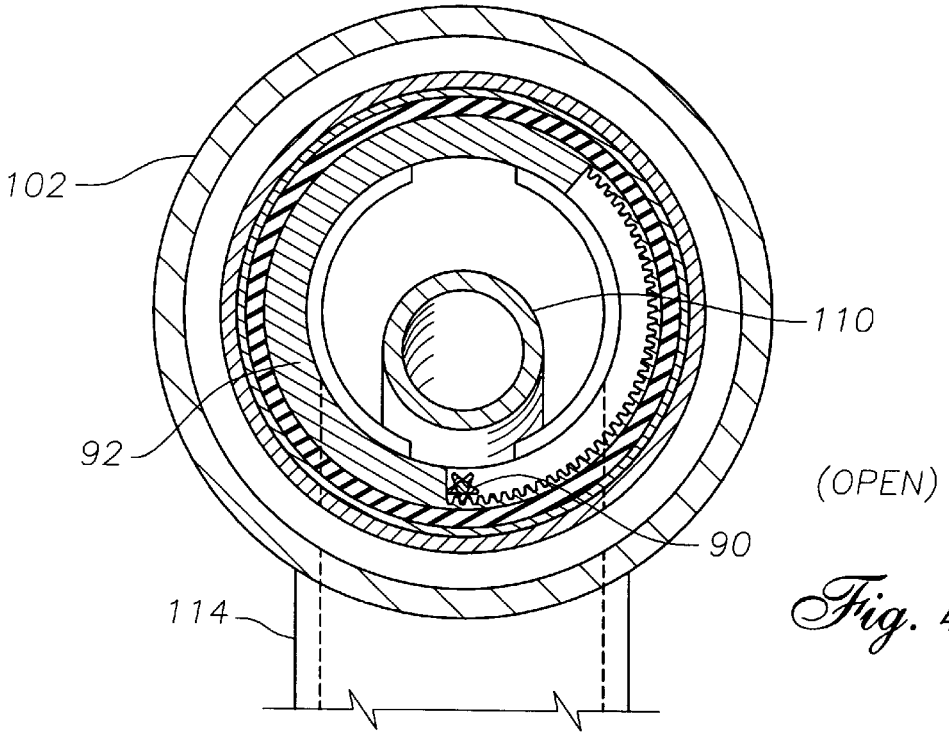
FIGS. 4 A–B illustrate two cross sections of FIG. 3 taken along line "A—A", without the service tools as shown therein.
Figure 4B:
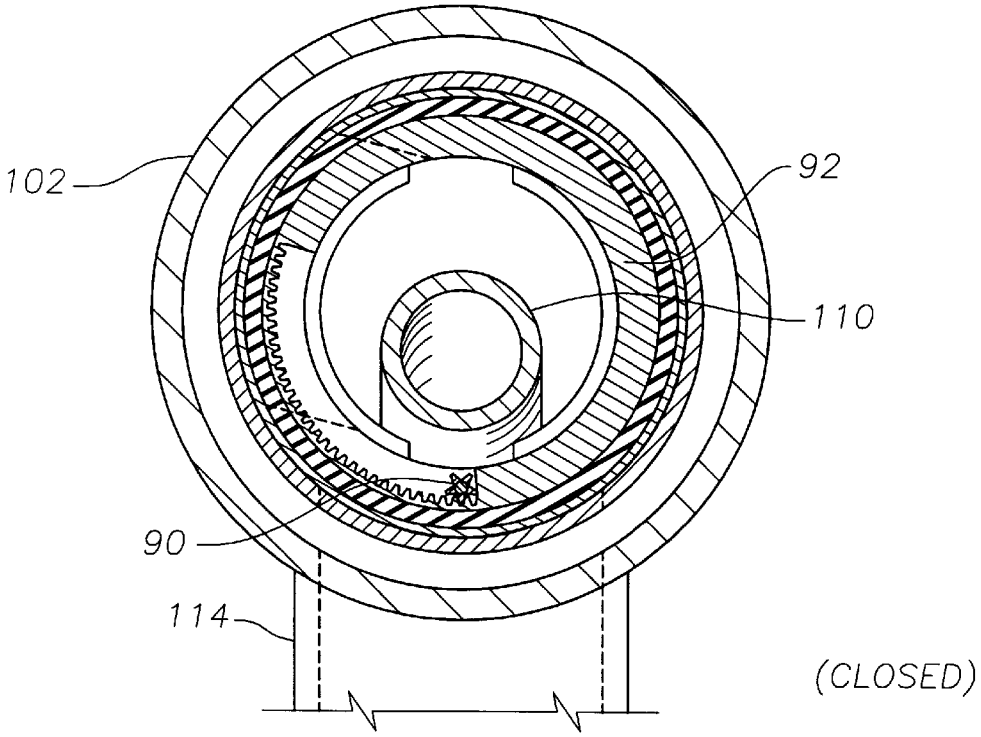
Figure 5:
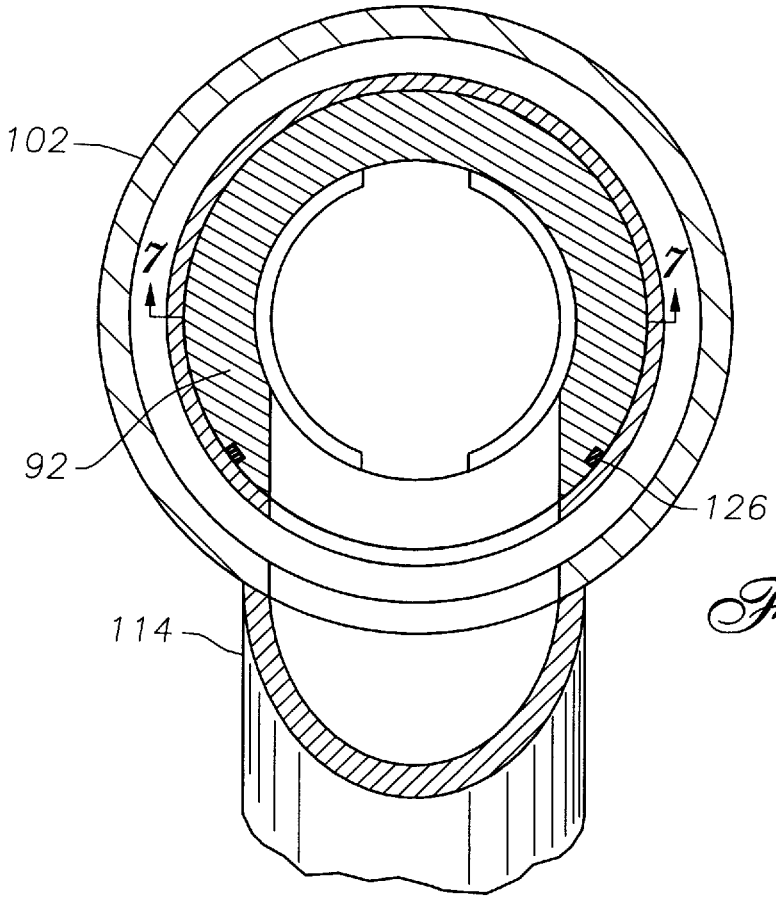
FIG. 5 illustrates a cross sections of FIG. 3 taken along line "B—B", without the service tools as shown therein.
Figure 6:
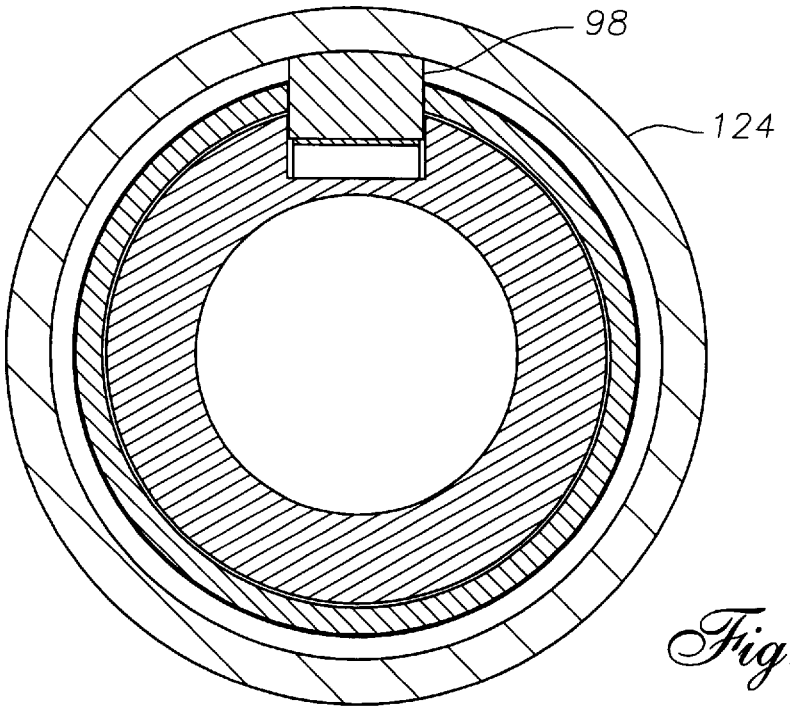
FIG. 6 illustrates a cross section of FIG. 3 taken along line "D—D", and depicts a locating, orienting and locking mechanism for anchoring the multilateral flow control system to the casing.

FIG. 4 A–B is a cross section taken at "A—A" of FIG. 3-D and shown without the flexible tubing member 110 in place represents a view of the top of the rotating lateral access door 92. FIG. 4-A illustrates the relationship of the well casing 102, the cased lateral 114, the pinion gear 90, and the rotating lateral access door 92, shown in the open position. FIG. 4-B illustrates the relationship of the well casing 102, the cased lateral 114, the pinion gear 90, and the rotating lateral access door 92, shown in the closed position. Referring now to FIG. 5, which is a cross section taken at "B—B" of FIG. 3-E, and is shown without the flexible tubing member 110 in place, at a location at the center of the intersection of the cased lateral 114, and the well casing 102. This diagram shows the rotating lateral access door 92 in the open position, and a door seal 126. FIG. 6 is a cross section taken at "D—D" of FIG. 3-F and illustrates in cross section the manner in which the selective orienting key 98 engages the casing nipple 124 assuring the assembly described herein is located and oriented at the correct position in the well.

Figure 7:
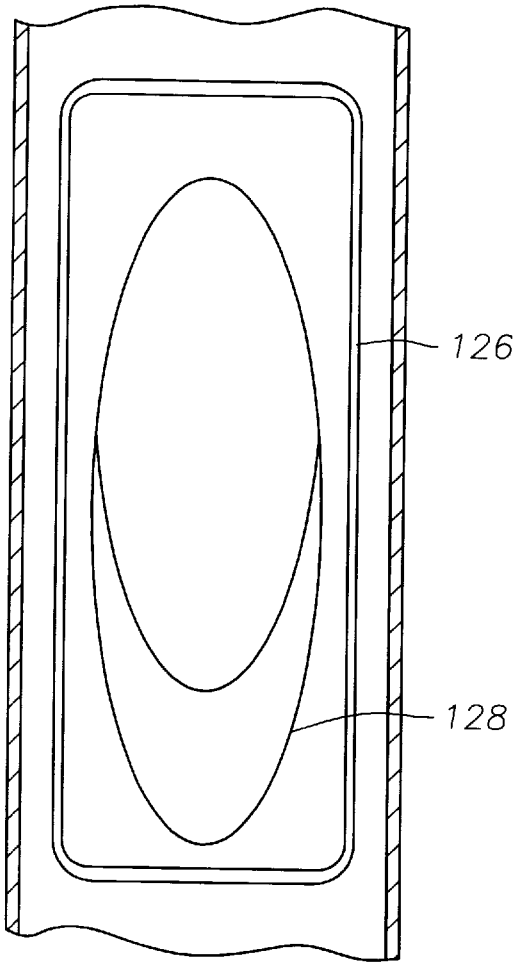
FIG. 7 illustrates a longitudinal section of FIG. 5 taken along line "C—C", and depicts an opening of the rotating lateral access door shown in the open position, and the sealing mechanism thereof
Figure 8:
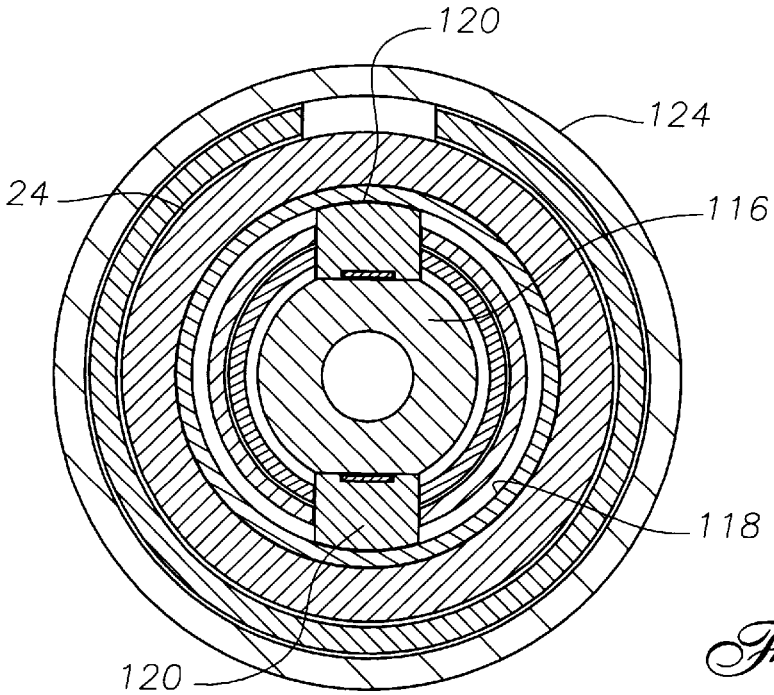
FIG. 8 illustrates a cross section of FIG. 3 taken along line "E—E", and depicts an orienting and locking mechanism for a selective orienting deflector tool and is located therein.

Turning now to FIG. 7, which is a longitudinal section taken at "C—C" of FIG. 5. This diagram primarily depicts the manner in which the door seal 126 seals around an elliptical opening 128 formed by the intersection of the cylinders formed by the cased lateral 114 and the rotating lateral access door 92. This view clearly shows the bevel used to ease movement of service tools into and out of the cased lateral 114. The final diagram, FIG. 8, is a cross section taken at "E—E" of FIG. 3-E. This shows the relationship of the casing nipple 124, the orienting deflector tool 116, the profile 118 formed in the interior surface of the upper fluid flow control apparatus 24, and how the locking keys 120 interact with the profile 118.

In a typical operation, the oil well production system of the present invention is utilized in wells with a plurality of producing formations which may be selectively produced. Referring once again to FIG. 1, if it were operationally desirable to produce from the upper producing zone 16 without co-mingling the flow with the hydrocarbons from the other formations; first a tubing plug 42 would need to be set in the tubing to isolate the lower producing zone (not shown). The operator standing at the control panel would then configure the control panel 40 to close the lower fluid flow control apparatus 26, and open the upper fluid flow control apparatus 24. Both rotating lateral access doors 30 would be configured closed. In this configuration, flow is blocked from both the intermediate producing zone 18, and the lower producing zone and hydrocarbons from the upper producing zone would enter the upper lateral 12, flow into the annulus 34, through the set of ports 46 on the upper fluid flow control apparatus 24, and into the production tubing 20, which then moves to the surface. Different flow regimes can be accomplished simply by altering the arrangement of the open and closed valves from the control panel, and moving the location of the tubing plug 42. The necessity of the tubing plug 42 can be eliminated by utilizing another flow control valve to meter flow from the lower formation as well.

When operational necessity dictates that one or more of the laterals requires re-entry, a simple operation is all that is necessary to gain access therein. For example, assume the upper lateral 12 is chosen for remediation. The operator at the remote control panel 40 shuts all flow control valves, assures that all rotating lateral access doors 30 are closed except the one adjacent the upper lateral 12, which would be opened. If the orienting deflector tool 116 is not installed, it would become necessary to install it at this time by any of several well known methods. In all probability, however, the deflector tool 116 would already be in place. Entry of the service tool in the lateral could then be accomplished, preferably by coiled tubing or a flexible tubing such as CO-FLEXIP brand pipe, because the production tubing 20 now has an opening oriented toward the lateral, and a tool is present to deflect tools running in the tubing into the desired lateral. Production may be easily resumed by configuring the flow control valves as before.

Whereas the present invention has been described in particular relation to the drawings attached hereto, it should be understood that other and further modifications, apart from those shown or suggested herein, may be made within the scope and spirit of the present invention.

What is claimed is:

1. A well completion, comprising:

at least one deviated lateral branch that extends from a central wellbore, and that intersects and communicates with at least one of fluid producing formation;

production tubing set within the wellbore and extending to the earth's surface;

packer means for isolating fluid flow from the at least one lateral branch into the wellbore;

a flow control assembly set within wellbore adjacent the at least one deviated lateral branch;

selectively operable fluid flow control means on the flow control assembly for alternately allowing and preventing fluid flow from the producing formation into the production tubing; and selectively operable lateral access means on the flow control assembly for alternately allowing and preventing service tool entry into the lateral branch.

2. The well completion of claim 1 wherein the fluid flow control means comprises a valve operable from commands sent from a control means at the earth's surface.

3. The well completion of claim 1 wherein the access means comprises a rotatable lateral door operable from commands sent from a control means at the earth's surface.

4. The well completion of claim 1 wherein the fluid flow control means is operated by a service tool deployed into the production tubing from the earth's surface.

5. The well completion of claim 1 wherein the access means is operated by a service tool deployed into the production tubing from the earth's surface.

6. The well completion of claim 2 wherein the commands from the control means are conveyed from the earth's surface through a hydraulic fluid control line.

7. The well completion of claim 3 wherein the commands from the control means are conveyed from the earth's surface through an electrical control line.

8. A flow control assembly comprising:

a body having a central bore extending therethrough, and having means on one end thereof for interconnection to a well tubing;

a selectively operable flow control valve in the body for regulating fluid flow between the outside of the body and the central bore; and a selectively operable lateral access door in the body for alternately permitting and preventing a service tool from laterally exiting the body therethrough.

9. The flow control assembly of claim 8 wherein the fluid flow control valve is operable from commands sent from a control means at the earth's surface.

10. The flow control assembly of claim 8 wherein the access door is operable from commands sent from a control means at the earth'surface.

11. The flow control assembly of claim 8 wherein the fluid flow control valve is operated by a service tool deployed from the earth'surface.

12. The flow control assembly of claim 8 wherein the access door is operated by a service tool deployed from the earth's surface.

13. The flow control assembly of claim 9 wherein the commands from the control means are conveyed from the earth's surface through a hydraulic fluid control line.

14. The flow control assembly of claim 10 wherein the commands from the control means are conveyed from the earth's surface through an electrical control line.

15. The flow control assembly of claim 8 wherein the flow control valve comprises a sleeve adapted to move axially within the bore of the body, and ports through the sleeve alignable with ports in the body to permit fluid flow into and out from the bore.

16. The flow control assembly of claim 8 wherein the lateral access door further comprises a plug member having a beveled exterior surface adapted to move in relation to an interior surface of the body to either close across or open a lateral access port in the body, and to guide a service tool out the lateral access port.

17. The flow control assembly of claim 8 and including a first packer adjacent a first end of the body and a second packer adjacent a second end of the body with the flow control valve and the lateral access door located therebetween.

* * * * *